United States Patent [19]

Cox

[11] 3,935,648

[45] Feb. 3, 1976

[54] TOBACCO CURING APPARATUS AND METHOD

[76] Inventor: Jack R. Cox, P.O. Box 1104, Myrtle Beach, S.C. 29577

[22] Filed: Nov. 7, 1974

[21] Appl. No.: 521,778

[52] U.S. Cl. ..... 34/131; 131/133 R; 34/219; 432/500

[51] Int. Cl.² ..... D06F 58/00; F26B 11/02

[58] Field of Search ..... 131/133 R X, 135, 136, 131/140; 432/500; 34/78, 131, 132, 133, 134, 139, 93, 13, 219, 233

[56] References Cited

UNITED STATES PATENTS

| | | | |
|---|---|---|---|
| 1,669,012 | 5/1928 | Nordstrom | 131/134 X |
| 2,505,313 | 4/1950 | Wagoner | 131/134 X |
| 3,272,207 | 9/1966 | Doyle | 131/133 R |
| 3,329,416 | 7/1967 | Jackson | 432/500 X |
| 3,359,989 | 12/1967 | Stocklocker | 131/134 X |
| 3,367,643 | 2/1968 | Copeland | 432/46 |
| 3,399,680 | 9/1968 | Egri | 131/134 |
| 3,594,918 | 7/1971 | Quester | 131/135 X |
| 3,866,334 | 2/1975 | Huang | 131/134 X |

FOREIGN PATENTS OR APPLICATIONS

| | | | |
|---|---|---|---|
| 487,602 | 3/1970 | Switzerland | 131/141 |

*Primary Examiner*—Robert W. Michell
*Assistant Examiner*—Vincent Millin
*Attorney, Agent, or Firm*—B. P. Fishburne, Jr.

[57] ABSTRACT

A plurality of foraminous wedge-shaped tobacco leaf containers with leaf impaling means are arranged in a circular array on a plenum foundation having connections with an external burner and blower assembly. A center passage for hot curing air is surrounded by the array of containers and the air flows radially outwardly through the containers and tobacco leaves with the leaves oriented edgewise to the air flow. A return annular air passage surrounding the containers leads back to the plenum and exterior burner and fan assembly. The exterior wall of the apparatus is insulated to confine heat. The air circulation may be reversed in the apparatus.

13 Claims, 6 Drawing Figures

FIG. 4
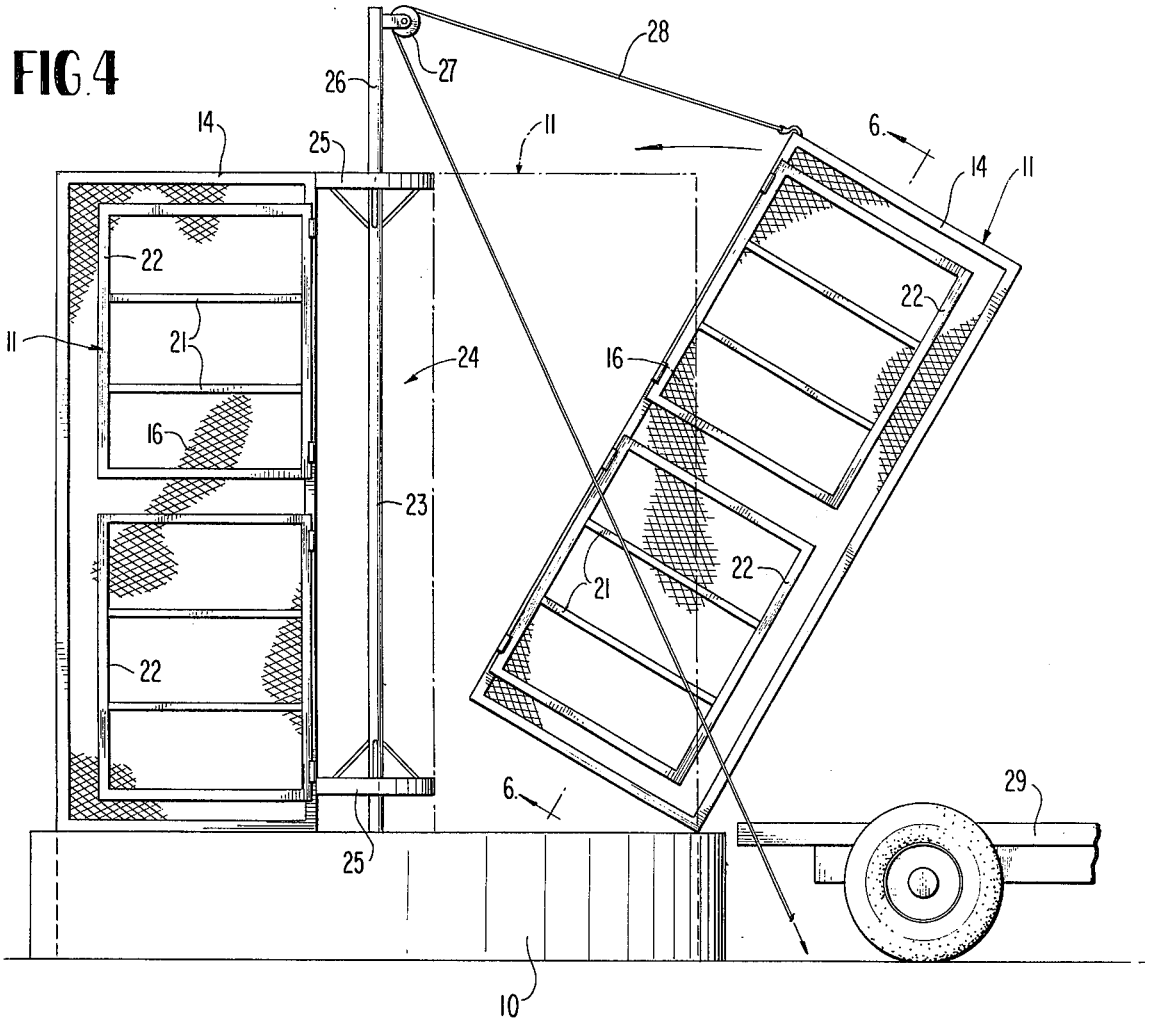
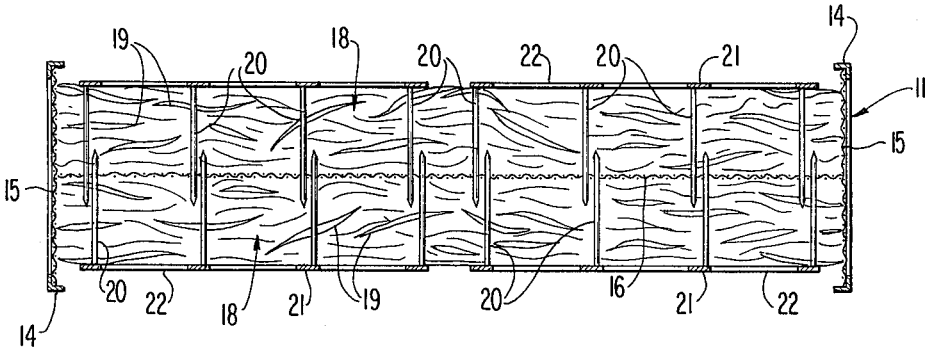
FIG. 6

TOBACCO CURING APPARATUS AND METHOD

BACKGROUND OF THE INVENTION

The conventional methods and means for curing tobacco leaves are archaic, makeshift, inefficient and inconvenient, to say the least. They are also unduly expensive. In most instances, the leaves are attached by hand to curing sticks, which are subsequently hung up or supported in barns having some means to provide hot air circulation into or through the leaves. With conventional practices, a great deal of time-consuming labor is involved in stocking the curing barn and in the subsequent removal of the cured tobacco. The air circulation system is crude generally, and results in uneven and incomplete leaf curing in many cases and under-curing in others.

The average cost of a tobacco curing barn today will be $6000–$7000 with the above-described imperfect results inherent in the arrangement.

The objective of this invention is to provide a much more efficient and reliable tobacco curing apparatus and method at about one-half the cost of the conventional prior art. Additionally, the invention eliminates a great deal of the hand labor customarily required for attaching tobacco leaves to hanger sticks and the invention allows for the mass handling of leaves in special curing containers where the leaves are properly oriented in relation to the flow of curing air for the most efficient and rapid curing. The apparatus is also constructed so that the curing air stream may be reversed to flow radially inwardly through the leaves in the foraminous containers as well as radially outwardly.

The invention also totally eliminates the traditional tobacco barn and instead thereof a much more economical curing structure is provided which can be quickly set up or dismantled with very little labor. A unique feature of the structure is that the several curing baskets or containers themselves form the body of the structure and need only be surrounded by a lightweight insulating wall which may be flexible. The base for the structure may be of concrete or a prefabricated metal base, if preferred. Means are also included to aid in the manipulation of the baskets which are quite heavy when loaded with tobacco leaves. Conventional burner and fan equipment arranged exteriorly of the curing apparatus may be employed.

Other significant features and advantages of the invention will become apparent during the course of the following detailed description.

BRIEF DESCRIPTION OF DRAWING FIGURES

FIG. 4 is a side elevational view of the apparatus illustrating the use of basket manipulating means.

FIG. 6 is a cross sectional view taken through a basket with the impaling means in the closed or active position relative to the leaves.

DETAILED DESCRIPTION

Figure 1:
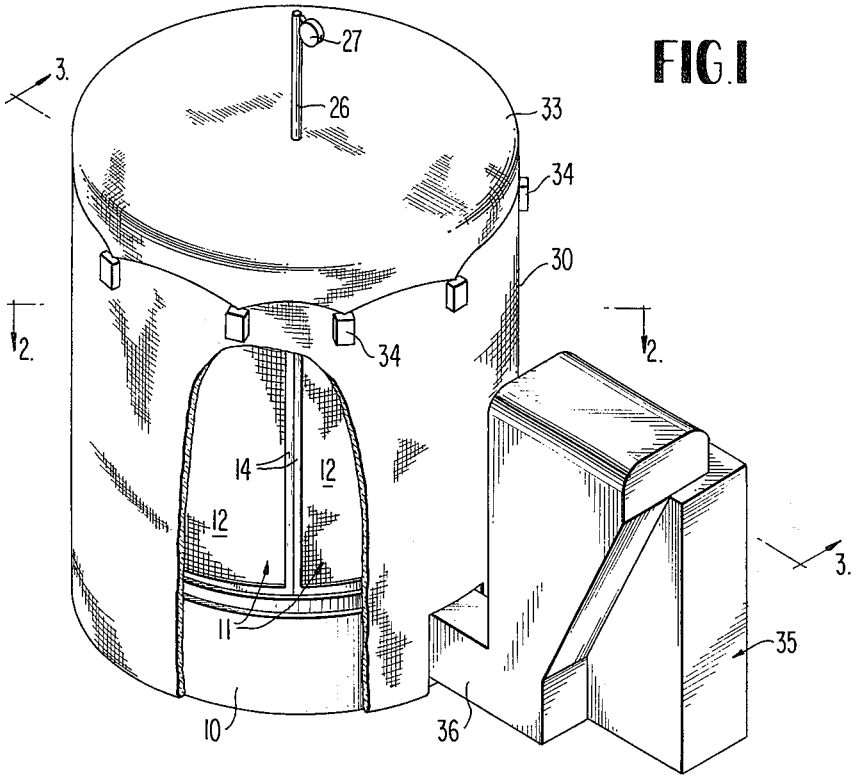
FIG. 1 is a schematic perpsective view of the invention, partly broken away.

Referring to the drawings in detail, the numeral 10 designates a circular concrete base or slab which may be formed at any desired location for the apparatus. In some cases, a prefabricated metal tank-like base may be utilized in lieu of the concrete base. In either case, the operation of the apparatus is the same.

Figure 2:
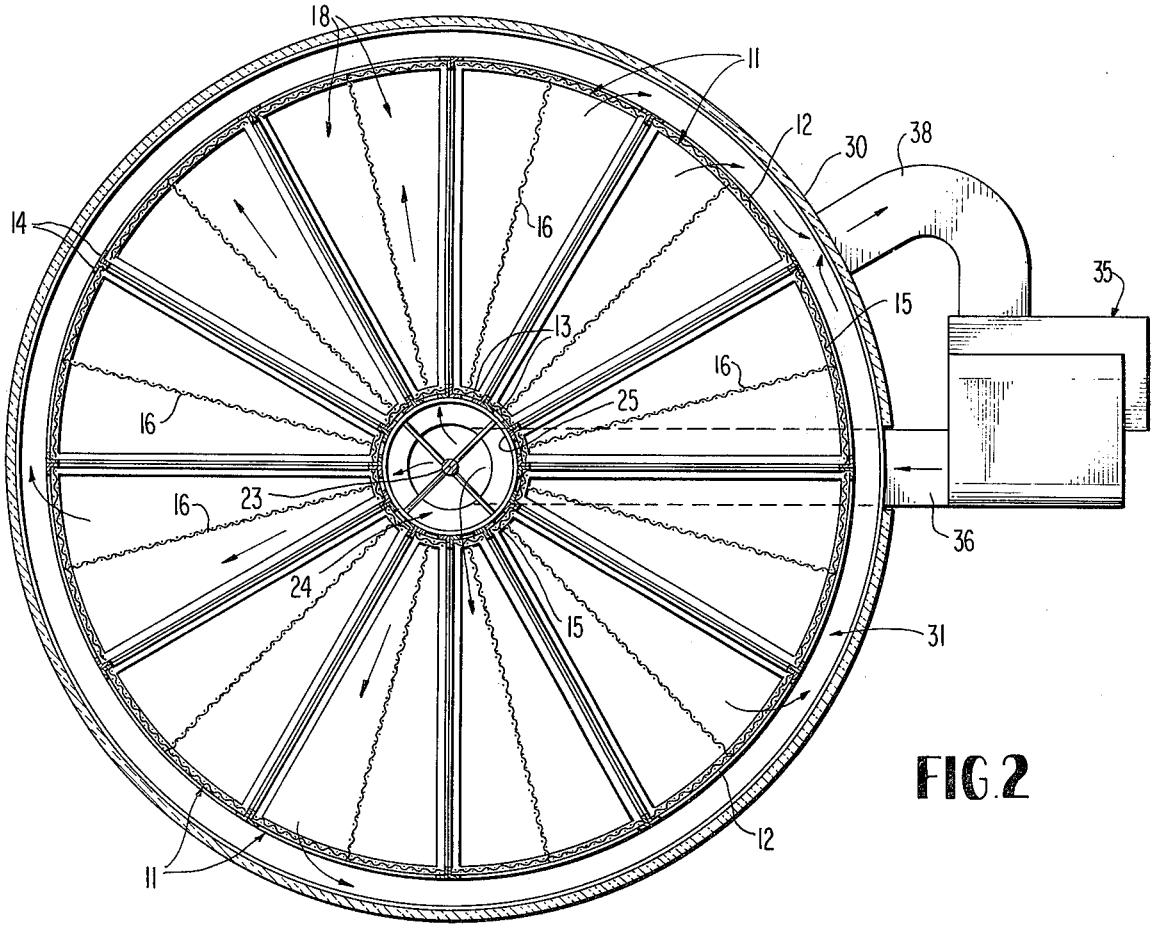
FIG. 2 is a horizontal section taken on line 2—2 of FIG. 1.
Figure 3:
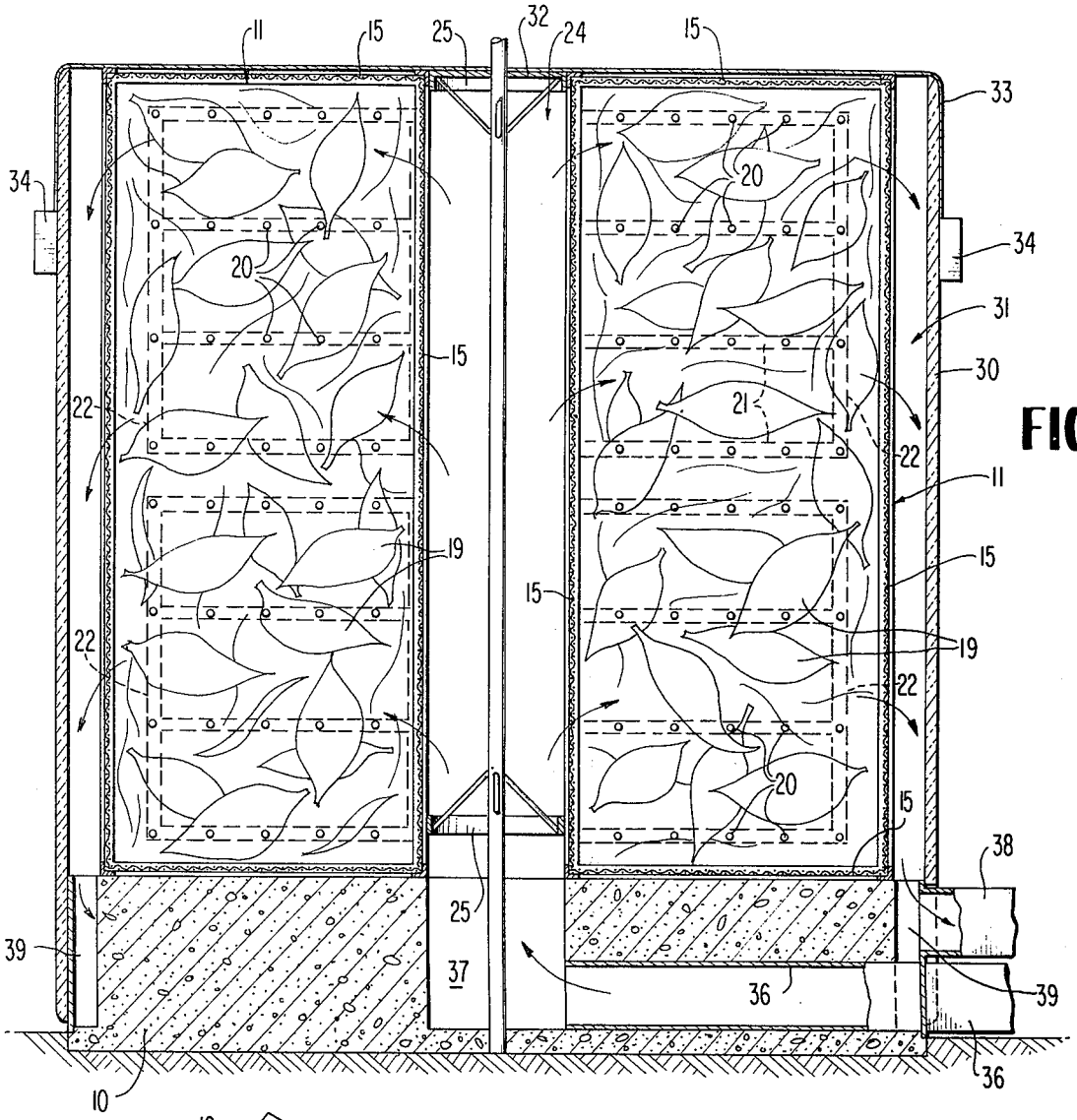
FIG. 3 is a vertical section taken on line 3—3 of FIG. 1.
Figure 5:
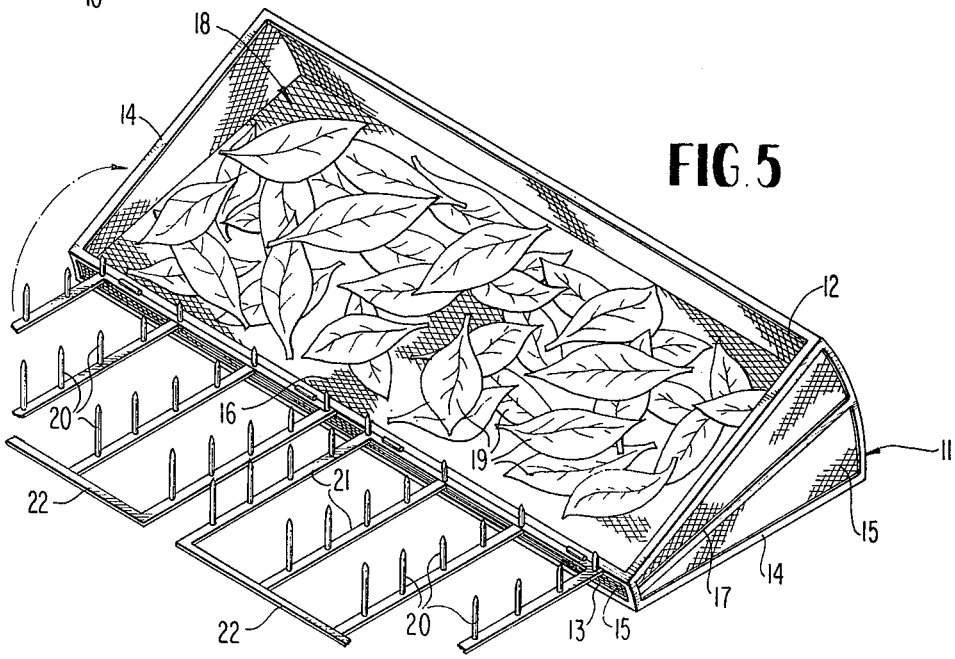
FIG. 5 is a perspective view of a leaf container or basket with the impaling means open.

A very important element of the invention comprises a tobacco leaf curing container or basket 11 shown in considerable detail in FIGS. 3, 5 and 6. A plurality, such as twelve, of the baskets 11 is utilized in the complete apparatus, as will be further explained. Each identical basket 11 is elongated in the vertical use position and is wedge-shaped in cross section so as to have a pair of radiating side walls, as viewed in FIG. 2, an outer circularly curved wall 12 and an interior narrow wall 13 which may be essentially flat. While the dimensions of the basket 10 may be varied, each basket is of considerable size and is preferably adapted to contain up to one-half ton of leaves to be cured. When twelve of the baskets are employed in the apparatus, as much as six tons of tobacco leaves may be efficiently cured in a minimum of time.

Each basket 11 comprises a rigid exterior frame 14 formed of sturdy metal bars or tubing including wedge-shaped frame ends and large rectangular open frame sides, as depicted in FIG. 5. The frame ends, as well as the inner and outer sides 12 and 13 of the basket, are covered with relatively heavy wire mesh or screening 15 of a construction which will confine tobacco leaves while at the same time allowing the free circulation of curing air through the container in a radial direction during use, FIGS. 2 and 3. Each basket 11 further comprises a middle foraminous divider wall 16 also formed of heavy screening and the margins of the divider wall 16 are suitably attached to intermediate frame bars 17 of the basket frame. The wall 16 divides the wedge-shaped basket into two equally sized curing compartments 18, each adapted to contain and confine a large mass of harvested tobacco leaves 19. In this connection, one of the main features of the invention is the ability of the basket or container 11 to hold the leaves in the compartments 18 oriented in a common plane extending edgewise to the radial flow of air outwardly or inwardly through the apparatus.

Toward this end, each open side of each basket 11 has a plurality of leaf penetrating sharp pins 20 or impaling elements preferably arranged in spaced rows transversely of the basket on mounting bars 21 which may form parts of rectangular frames 22 which are hinged to the adjacent open sides of the basket, as shown. The arrangement is such that, after filling the compartments 18 with leaves 19 disposed randomly in a common plane, the frames 22 are swung to closed positions shown in FIG. 6 with the pins 20 penetrating through the leaves 19 randomly thus securing the mass of leaves in each chamber 18 against appreciable movement during the handling of the basket 11 or during the actual air curing procedure. If needed, in some cases, a conventional latching means, not shown, may be employed to secure the pin carrying frames 22 in their closed active positions. The pins 20, FIG. 6, are long enough to penetrate through the foraminous wall 16 so that the latter can give support to the distal ends of the pins.

As shown in FIG. 2 which illustrates a preferred embodiment of the invention, twelve of the baskets 11 filled with leaves 19 in both compartments 18 are placed on end on top of base 10 to form a circular array of foraminous baskets. A greater or lesser number of baskets may be employed in some instances but twelve is thought to be a practical number in terms of a desirable size for the individual baskets. To assure proper arrangement and stabilization of baskets 11, a sturdy center post 23 has its lower end anchored to the base 10 and extends vertically through the center passage or "stack" 24 defined by the inner vertical edges or walls 13 of the baskets. The center post 23 has a pair of basket locator rings 25 fixedly attached to it adjacent the tops and bottoms of baskets 11 and these rings aid in positioning the baskets in the proper circular array on the base 10. A top extension 26 on post 23 serves to support a sheave 27 above the top of the apparatus by means of which a cable 28, FIG. 4, is utilized to manipulate the filled baskets 11 as when they are removed from or placed on a transporting truck 29. It will be realized that the weight of the filled baskets is considerable and such a mechanical aid in maneuvering them is desirable. If desired, other forms of maneuvering devices may be used.

After placement of the baskets 11 on the base 10, an insulated cylindrical side wall covering 30 or enclosure is placed around the assembly and preferably extends from the tops of the upstanding baskets to a point near the bottom of the base 10. This covering or enclosure 30 may be flexible and may consist of inner and outer canvas layers with an intervening thick blanket of heat insulation material. The enclosure 30 may be divided at one or more points around the apparatus so that it may be parted and connected by lacing or banding means, not shown. Alternatively, the enclosure 30 may comprise plural curved segments of rigid insulating material, such as plastic foam which can be set up around the apparatus and detachably connected by any suitable means to form a continuous insulating wall. As shown, an annular return passage 31 for curing air is provided between the enclosure 30 and the periphery of the assemblage of baskets 11. This passage 31 is a few inches in radial width and extends continuously around the apparatus for its full height. Where the enclosure 30 is flexible in nature, the pressurizing effect of the curing air passing radially outwardly through the baskets 11 will maintain the passage 31 properly defined and will assist the enclosure 30 in being self-standing. In some cases, a relatively light framework, not shown, for the insulated enclosure 30 may be provided.

The top of the central passage 24 is preferably covered by a plate 32, and a flexible circular tarp 33 is placed over the top of the apparatus and may be held in place by attached building blocks 34 or similar weights. The tarp prevents the escape of curing air from the top of the apparatus and the enclosure 30 confines the air around the circumference. The base 10 prevents escape of air at the bottoms of the baskets 11, whereby the apparatus is sufficiently air-tight to enable the curing process with a high degree of efficiency.

A conventional burner and fan unit 35 of the type used to cure tobacco leaves is arranged outside of the apparatus, FIG. 1, with a delivery duct 36 for hot curing air entering through a radial opening in the base 10, FIG. 3, at one side thereof and extending to the bottom of a vertical passage 37 which communicates directly with the bottom of the longer passage 24. A return duct 38 for curing air communicates at one point with the bottom of the return passage 31, which leads at its bottom into an annular space 39 formed around the base 10 and connecting directly with the duct 38, as best shown in FIG. 3.

With this arrangement, the curing air at the desired temperature is pumped from the unit 35 through delivery duct 36 and upwardly into central passage 24 and then radially outwardly in all directions through the foraminous baskets 11, and then into the return annular passage 31 leading to return duct 38 for unit 35 outside of the apparatus. The burner and fan unit 35 is reversible as to direction of flow so that periodically the flow of curing air can be forced to flow first into passage 31 and then radially inwardly through the baskets 11 and downwardly in passage 24 and into duct 36. In either case, the curing air will flow radially through the tobacco leaves 19 which are held in vertical planes in the baskets edgewise to the direction of gas flow, whereby the leaves themselves will not impede the flow and will receive the curing air or gas on all surfaces for uniform and complete curing.

After the required time of curing in the apparatus, the burner unit is turned off and the cover 33 is removed along with enclosure 30 and the cured tobacco leaves in the baskets 11 may be transported to a desired location and removed for further use.

The apparatus as described will accommodate all of the operational requirements for properly curing tobacco according to known standards of temperature and times of curing to effect the desired leaf coloring and drying, as well as the "killing" of the leaf and leaf stem. Additionally, the invention process is a great improvement over conventional practice in terms of efficient air flow through the leaves and the ability of the apparatus to process a much greater poundage of tobacco leaves in a smaller space and lesser time, with more economical equipment. The reversibility of the air flow renders the invention even more versatile in its ability to cure leaves completely and uniformly.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. An apparatus for curing tobacco leaves comprising means defining an annular curing air confining enclosure, a plurality of foraminous baskets for leaves adapted to be arranged in a circular array within the enclosure wherein said baskets form a central verical passage in the center of said circular array and an exterior annular return passage defined by the inner wall of the enclosure and the outer wall of said baskets, and means on the baskets adapted to engage masses of tobacco leaves therein and to hold said leaves relatively fixed against appreciable movement during curing with the leaves held approximately edgewise to the direction of curing air flowing therethrough radially between said passages.

2. The apparatus of claim 1, and said baskets being vertically elongated when in their use positions and being wedgelike in cross section with their narrower sides disposed innermost around said central vertical passage.

3. The apparatus of claim 2, and said baskets each comprising a substantially rigid frame and foraminous panel material attached to said frame to define the walls of the basket.

4. The apparatus of claim 3, and a center foraminous divider panel on each basket dividing it into two equally sized compartments for tobacco leaves on opposite sides of said center divider panel.

5. The apparatus of claim 1, and said last-named means including a plurality of impaling pins adapted to penetrate through tobacco leaves to prevent substantial relative movements thereof in said baskets.

6. The apparatus of claim 5, and supporting frame means for said impaling pins facilitating the movement of the pins to and from penetrating engagement with said leaves.

7. The apparatus of claim 6, and said supporting frame means for said pins hingedly secured to said baskets adjacent opposite open sides thereof.

8. The apparatus of claim 1, and a base for the support of said circular array of baskets and having inlet and outlet passage means in communication respectively with said central vertical passage and said annular return passage.

9. The apparatus of claim 8, and a burner-fan unit arranged exteriorly of the apparatus and having air delivery and return ducts coupled with said passages of said base.

10. The apparatus of claim 1, and said means defining said enclosure comprising an insulated wall structure extending around the periphery of said baskets and spaced from said periphery to form therewith said exterior annular return passage.

11. The apparatus of claim 10, and a tarp element covering the top of said apparatus to prevent the escape of curing air upwardly therefrom.

12. The apparatus of claim 1, and a center post disposed in the central vertical passage, and basket locator rings secured to said post near the tops and bottoms of the basket.

13. The apparatus of claim 12, and a top extension on said center post projecting above the apparatus and supporting basket manipulating mechanical means for use in placing baskets in curing positions or for removing them after curing.

* * * * *